US007051809B2

(12) United States Patent
Wilson

(10) Patent No.: US 7,051,809 B2
(45) Date of Patent: May 30, 2006

(54) BURN ASSISTED FRACTURING OF UNDERGROUND COAL BED

(75) Inventor: Dennis Ray Wilson, Katy, TX (US)

(73) Assignee: Conocophillips Company, Houston, TX (US)

( * ) Notice: Subject to any disclaimer, the term of this patent is extended or adjusted under 35 U.S.C. 154(b) by 111 days.

(21) Appl. No.: 10/656,436

(22) Filed: Sep. 5, 2003

(65) Prior Publication Data

US 2005/0051328 A1 Mar. 10, 2005

(51) Int. Cl.
*E21B 43/243* (2006.01)

(52) U.S. Cl. ..... 166/259; 166/302

(58) Field of Classification Search ..... 166/259, 166/261, 302, 308.6, 308.1, 257, 245
See application file for complete search history.

(56) References Cited

U.S. PATENT DOCUMENTS

| | | | | | |
|---|---|---|---|---|---|
| 2,593,477 | A | | 4/1952 | Newman et al. | |
| 3,004,596 | A | * | 10/1961 | Parker et al. | 166/245 |
| 3,032,103 | A | * | 5/1962 | Parker | 166/256 |
| 3,239,405 | A | * | 3/1966 | Parrish | 166/261 |
| 3,298,434 | A | * | 1/1967 | Graham | 166/250.15 |
| 3,448,807 | A | * | 6/1969 | Strickland, Jr. | 166/256 |
| 3,794,116 | A | * | 2/1974 | Higgins | 166/259 |
| 3,933,447 | A | * | 1/1976 | Pasini et al. | 166/259 |
| 4,026,356 | A | | 5/1977 | Shuck | 166/259 |
| 4,063,416 | A | * | 12/1977 | Cooper | 60/641.7 |
| 4,099,567 | A | * | 7/1978 | Terry | 166/261 |
| 4,185,692 | A | * | 1/1980 | Terry | 166/257 |
| 4,245,699 | A | | 1/1981 | Steeman | 166/271 |
| 4,271,904 | A | | 6/1981 | Ginsburgh et al. | 166/251 |
| 4,299,285 | A | | 11/1981 | Tsai et al. | 166/259 |
| 4,343,361 | A | | 8/1982 | Ginsburgh et al. | 166/251 |
| 4,356,866 | A | * | 11/1982 | Savins | 166/261 |
| 4,448,252 | A | * | 5/1984 | Stoddard et al. | 166/402 |
| 4,498,537 | A | * | 2/1985 | Cook | 166/257 |
| 4,589,491 | A | * | 5/1986 | Perkins | 166/302 |
| 5,027,896 | A | * | 7/1991 | Anderson | 166/251.1 |
| 5,417,286 | A | | 5/1995 | Palmer et al. | 166/308 |
| 5,494,108 | A | | 2/1996 | Palmer et al. | 166/308 |
| 5,566,756 | A | | 10/1996 | Chaback et al. | 166/263 |
| 5,653,287 | A | | 8/1997 | Wilson et al. | 166/302 |
| 5,669,444 | A | | 9/1997 | Riese et al. | 166/263 |
| 5,853,224 | A | | 12/1998 | Riese | 299/13 |
| 5,865,248 | A | | 2/1999 | Riese et al. | 166/263 |
| 5,868,248 | A | | 2/1999 | Joh | 206/315.6 |
| 5,944,104 | A | * | 8/1999 | Riese et al. | 166/263 |
| 5,964,290 | A | | 10/1999 | Riese et al. | 166/263 |
| 5,967,223 | A | | 10/1999 | Kagan et al. | 164/481 |
| 6,016,873 | A | * | 1/2000 | Hsu et al. | 166/402 |
| 6,024,171 | A | | 2/2000 | Montgomery et al. | 166/308 |
| 6,119,778 | A | | 9/2000 | Seidle et al. | 166/263 |
| 6,244,338 | B1 | | 6/2001 | Mones | 166/245 |
| 6,280,000 | B1 | | 8/2001 | Zupanick | 299/12 |
| 6,412,559 | B1 | | 7/2002 | Gunter et al. | 166/271 |
| 6,450,256 | B1 | | 9/2002 | Mones | 166/250.01 |

* cited by examiner

*Primary Examiner*—David Bagnell
*Assistant Examiner*—Daniel P Stephenson
(74) *Attorney, Agent, or Firm*—Hitchcock Evert LLP

(57) ABSTRACT

A method for fracturing subterranean coal formations by injecting air into the formation, igniting the coal, driving the fire away from the wellbore by injecting a cooling media into the burning formation adjacent the wellbore, and subsequently extinguishing the fire. The method allows fractionation and fracture crosion of subterranean coal formations and offers the benefit of increasing production of clean gas from the coal formation.

35 Claims, No Drawings

BURN ASSISTED FRACTURING OF UNDERGROUND COAL BED

TECHNICAL FIELD OF THE INVENTION

The present invention relates to the treatment of underground coal formations and in particular a method to fracture those formations.

BACKGROUND OF THE INVENTION

Coal is probably the most plentiful hydrocarbon fuel on earth. However, a large volume of the coal deposits are in deep underground formations. There have been a number of efforts to exploit this energy source. Wells have been drilled into these deep coal formations and the hydrocarbon gases present in the formations have been extracted from the wells. These coal formations have been fractured utilizing techniques borrowed from the oil and gas well technology, using fluids such as water, gels, or foam fractionation, along with sand proppant, to create fractures in the formation to increase the production of gas from the coal formation. Gas produced by coal formations is relatively clean and may be processed in a manner similar to natural gas and transported via pipelines.

Another technique to exploit the energy reserve in deep coal beds has been to drill two or more wells into the coal formation. The coal in the formation is set on fire at one of the wells and the gaseous products of the burning coal are extracted through other wells. This method produces a gas product which was relatively dirty containing carbon monoxide, long-chain hydrocarbons, and other combustion products from the burning coal. Thus, the produced fuel gas is useful in powering electric generators located near the well heads, such a procedure is illustrated in U.S. Pat. No. 4,271,904 entitled "Method for Controlling Underground Combustion". The gas produced by the burning coal is of limited value for transportation of a clean gas which is competitive with natural gas.

There has been a continuing need for a method to more effectively fracture underground coal formations to recover more of the gas present in the formation. There has been a need for an improved process to recover the gas in a relatively clean form. The present invention has the advantages of being economical, of greatly extending the fracturing of subterranean coal formations, and of increasing the recovery of clean gas without the combustion products from burning underground coal in-situ to produce a product gas.

SUMMARY OF THE INVENTION

A method for using in place coal energy to improve and increase fracturing of subterranean coal formations at reduced cost. The method can be used in place of conventional processes or can be used in conjunction with conventional processes.

A method for the fracturing of subterranean coal formations comprising injecting an oxidizing gas into a wellbore and into the coal formation, igniting the coal, injecting a cooling media to force the fire away from the near wellbore media. After a predetermined time the fire is extinguished. In preferred embodiments the oxidizing gas is air.

In a preferred embodiment, the oxidizing gas is injected at a pressure substantially equal to or exceeding the fracturing pressure of the coal formation. The amount of cooling media injected is preferably less than the amount needed to completely extinguish the burning coal. A preferred cooling media is water, water mist, or foamed water. Preferably, the amount of cooling media injected is 60% or less of the BTU value of the burning coal. When the predetermined amount of burning has been completed, the fire is extinguished by injection of sufficient cooling media to extinguish the fire or to suffocate the fire.

In another embodiment, after a fire has been established in the coal, a slug of water can be injected of sufficient volume that it will explosively disassociate to further fracture the coal formation.

In yet another embodiment of the invention, a single wellbore is open to the coal formation. When a coal formation has more than one wellbore drilled into it, preferably all nearby wellbores are closed off before igniting the coal.

In another aspect the present invention relates to the provision of improved formation fracturing by burning the coal thereby converting the coal to ash to create fractures.

In yet another aspect the present invention provides a method to alter the natural stress field of the coal formation, by burning the coal to heat adjacent areas of the formation to a temperature which relieves stresses in the formation that would otherwise close opened fractures and cleats.

DETAILED DESCRIPTION

Some of the energy content in subterranean coal formations is accessed by drilling a wellbore into the coal formation. Drilling a well is usually the only practical way to access coal at depths below 1,000 feet from the surface. These coal formations typically contain methane and other hydrocarbon gases which can be produced from the well. Methane desorbs from coal matrix and can only move through the formation via fractures called butt cleats and cleats. To improve a well's ability to produce gas, coal formations can be fractured by fracturing techniques such as those used in natural gas and petroleum wells. The purpose of fracturing is to provide fissures or channels through which gas and fluids can migrate to the wellbore for extraction to the surface. However, such techniques as hydraulic fracturing with a variety of fluids and proppants, can extend fractures only a limited distance from the wellbore into the formation. These techniques are also quite expensive. The present invention provides an alternative technique to fracture a subterranean coal formation to increase the production of clean gas from the formation.

The present invention provides a method of fire fractionation to open up cleats and fissures in the subterranean coal formation. By only requiring and paying for necessary equipment and horse power at surface to inject a quantity of air at a sufficient pressure to utilize in-situ coal energy a less expensive technique involving a larger area can be accomplished. The method offers the ability to extend fractures beyond the range possible from typical foam fractionation and other fluid proppant combinations.

The present invention also has the advantage of being useful with a coal formation into which a single well has been drilled. The invention can also be used with formations having multiple wells.

The present invention can be used in wells which have a substantially vertical borehole or ones which have boreholes produced by directional drilling. In the preferred embodiment of the present invention, air is injected into the coal formation via the wellbore. Any oxidizing gas may be used. Air is the preferred oxidizing because it is inexpensive. Oxygen or oxygen-enriched air can also be utilized. Preferably, air is pumped into a well and underlying coal formation at a rate and pressure which is above the reservoir pressure and substantially equal to or greater than the fracturing pressure of the coal formation. The injection pressure can be less than the fracturing pressure of the formation and the method still be employed as long as sufficient rate of several thousand standard cubic feet per minute can be injected in order to involve a sufficient amount of coal into the process. Injected water, water vapor, or foamed water, will cool the wellbore and remove heat on the near wellbore side of the reaction. This results in an increased volume entering the formation due to heat expansion of air, conversion of water to steam, disassociation of water, and will cause gas volume to move outward at a high rate from the wellbore, elevating pressure until it fractures the formation and opens the natural cleat system. Injecting air at a pressure in excess of the fracturing pressure is preferred as it will tend to open up the natural cleats in the coal formation and increase the rate of oxidation and temperature. Injecting air at elevated pressure prior to providing an ignition source starting the oxidation process may be beneficial as oxygen will be adsorbed onto the coal face and be available to react quickly. If the formation has previously been fractured by other techniques, injecting the oxidizing gas at a pressure above the facturing pressure will tend to open up those pre-existing fractures and also increase the amount of oxygen adsorbed. Preferably, air is continued to be pumped into the formation in order to saturate the coal in the volume near the wellbore so that the coal will become enriched with oxygen prior to ignition of the coal. A record of the volume of oxidizing gas injected into the wellbore should be maintained.

After injecting a predetermined volume of oxidizing gas, the coal is then ignited by any suitable method. In one method, the coal is ignited by heating the oxidizing gas above the ignition temperature for the coal which is about 1,200° F. This can be accomplished by any suitable technique, such as lowering a heating element into the borehole to heat the oxidizing gas as it enters the wellbore adjacent to the coal formation. Another method of igniting the coal, is to inject a starting fuel adjacent to the coal formation to be ignited. The starting fuel may either be a hydrocarbon containing gas or liquid, such as diesel fuel, kerosene, etc. An igniter is lowered into the wellbore adjacent to the fuel in order to ignite the fuel. Another simple ignition system would be to place an ignition source in a perforated joint of tubing with the bottom blanked off, at the bottom of tubing string positioned across the coal interval. Pumping a small amount of fuel such as diesel down the tubing, followed with a displacement plug or ball, and displacing it with air containing water mist above displacement plug or ball. Air can be continuously injected down an annulus between tubing and casing, down tubing string, or both. The ignition source can be a marine flare or similar device, when fuel reaches ignition source with oxygen available it will be ignited and injected into the coal interval causing the coal to become ignited.

In the event that there are several separate layers of coal formations in the same wellbore, the layers can be either be separately ignited or two or more of the layers can be ignited, or all can be ignited at the same time. To prevent cross over ignition from one coal layer to other layers, a packer can be used to block off the layers that are not to be ignited.

Once the coal is ignited it will burn and the fire will predominantly follow the path of fractures, fissures and cleats into which the oxidizing gas has been injected. The flow of oxidizing gas can be continued during the ignition phase and after the coal has been ignited. Once ignited the fire should be driven from the near wellbore area. If left unchecked, the fire would become hot enough in the wellbore area to melt the tubing and casing in the wellbore. Further, uncontrolled localized burning in the area of the wellbore would merely produce a larger cavern near the wellbore but not achieve significant extension of fractures, cleats, and fissures which can be used for increasing the production of gas.

In the event that the formation is penetrated by more than one wellbore, all but one of the wellbores are preferably sealed to prevent contamination of produced gas due to channeling to the other boreholes by the exhaust of oxidizing gas through the open borehole. This causes the fire to channel and follow the path of the oxygen. Channeling between two wellbores may increase production by providing improved pathway between wellbores with both wells producing from it. The main intent is to cause fractures and fissures projecting radially from the wellbore in all directions. In large formations, oxidizing gas can be injected in two or more wells simultaneously, and a fire started adjacent to multiple wellbores and forced outward into the formation from multiple wellbores. Simultaneous injection is not preferred because as the fires radiate from multiple wellbores, formation pressure will be elevated requiring more horse power to inject air and water and may reach the pressure limitation of the wellbore casing.

To prevent localization of the fire in the volume of the coal formation near the wellbore, the present invention provides a method to force the fire away from the wellbore. The fire is forced away from the borehole by injecting a cooling media into the borehole in the vicinity of the coal formation. The cooling media can be a water mist, or a form containing water, or other suitable media. Water in a mist form is preferred for economic and ease of handling reasons.

By conducting a mass balance, one can determine from the amount of oxygen which has been injected in the coal formation the amount of coal that amount of oxygen would burn. From this information, the BTU value of the burning coal can be determined. The amount of cooling media injected to force the fire away from the borehole is an amount which is sufficient to allow the BTU balance of the burning coal to remain positive for continued burning. Preferably the cooling media injected is in a quantity such that the BTU content of the air, coal and cooling media is 60% or less than the BTU content of the coal and air. The quantity of cooling media is more preferably such that the BTU content of the air, coal and cooling media is from 60% to 10% of the BTU content of the air and coal without the cooling media. When the cooling media contains water it will disassociate on the side of the fire near the wellbore. The water injected into the wellbore at the area of the burning coal will disassociate cooling the near wellbore area and forcing the fire outwards from the wellbore. On the outside edge of the fire, the water will recombine (re-associate) to produce possibly some water, carbon dioxide, carbon monoxide, methane, and some long-chain carbon molecules. Disassociation is an endothermic reaction removing heat with products traveling to the opposite side of the fire to re-combine which is an exothermic reaction, and will aid in the continued burning of the coal away from the wellbore.

As the coal burns, it will leave ash. The ash content of the coal will vary depending on the type of coal, and the volume of ash will typically be ten to twenty percent of the volume of the unburned coal. The ash will occupy much less space than the coal that was burned, thus burning of the coal creates fractures and passageways through the formation while eroding a path through them at the same time. Thus, by converting the coal to ash, large fractures and passageways are created.

The burning can be maintained by pumping air and the cooling media, such as water mist, into the borehole for a predetermined length of time. The flow rates of the cooling media and air are monitored to maintain a predetermined Volume of cooling media with respect to the burning coal. The volume of cooling media injected is preferably that which is sufficient to maintain the BTU content of the cooling media, air and coal at 60% or less of the BTU content of the air and coal. The process can be continued for several hours, several days or longer as desired.

Once the desired amount of burning has been accomplished, the fire is extinguished by stopping air injection, by providing excess water into the wellbore, or both. Simply shutting in the injection well for a period of time will suffocate the fire also. A non-combustible gas can also be injected to assist in suffocating the fire.

If desired, prior to extinguishing the coal, a large slug of water can be injected into the well. The purpose of this injection is to achieve the further fracturing of the coal formation. When the slug of water reaches the intense heat of the fire in the formation, it will explosively turn to steam and disassociate with great force causing further fractures in the formation. A slug of water refers to the injection of water at a high rate of flow to inject a predetermined quantity of water. In a preferred embodiment, the slug of water is injected when it is desired to extinguish the fire thereby achieving additional fracturing while at the same time extinguishing the fire.

After the coal has been extinguished, the well can be placed back into production. The initial production may contain some of the combustion gas products. The quality of the gas produced from the formation will improve as the combustion products are adsorbed into the formation and also removed from the well. After the combustion products have been removed from the well, the gas produced will be of a quality similar to that achieved from the well without burning of the coal. Thus, the present invention provides a method to fracture a well which is much more economical than fluid mechanical fracturing, and can extend the fractures much further than conventional fracturing techniques while eroding a pathway to the wellbore by consuming coal and turning it into ash along one or more main fracture paths. The method of the present invention results in the conversion of a portion of the coal to ash. Since the ash content and volume is substantially less than that of the coal, fractures and cleats of a larger size than possible with a conventional process are created.

In another aspect, the present invention provides a method to reduce natural stresses in the formation. The burning of the coal will elevate the temperature of the formation surrounding the burning and relieve stresses in the formation which if not relieved would tend to cause the smaller cleats and fractures to close. It is believed that the heating will improve the micro cleat system and the ability of the formation to desorb gas.

While the present invention has been described in relation to preferred embodiments, the invention is not limited to the specific details disclosed herein.

The invention claimed is:

1. A method for the fracturing of underground coal deposits comprising:

a. providing one or more injecting wellbores to an underground coal formation;

b. sealing all other boreholes to said underground coal formation to which burning could channel from one or more of said injecting wells;

c. injecting an oxidizing gas through said one or more injecting wellbores and into said underground coal formation;

d. igniting the coal in said underground coal formation; and e. injecting a predetermined amount of a cooling media to force the burning of the coal away from said one or more injecting wellbores.

2. A method of claim 1 further comprising:

extinguishing the burning coal.

3. A method of claim 1 further comprising:

injecting a slug of water into the formation in which the coal is burning to cause additional fracturing of the coal formation.

4. A method of claim 1 wherein said oxidizing gas is air enriched with oxygen.

5. A method of claim 1 wherein said oxidizing gas is air.

6. A method of claim 1 wherein said cooling media is water.

7. A method of claim 1 wherein said predetermined amount of a cooling media is less than the amount needed to offset the BTUs produced by the burning coal.

8. A method of claim 1 wherein said cooling media is a foam containing water.

9. A method for the fracturing of underground coal deposits comprising:

a. injecting an oxidizing gas through a wellbore and into an underground coal formation;

b. igniting the coal in said underground coal formation;

c. injecting a predetermined amount of a cooling media to force the burning of the coal away from said wellbore; and wherein said cooling media is a foam containing water.

10. A method of claim 9 further comprising:

extinguishing the burning coal.

11. A method of claim 9 further comprising:

injecting a slug of water into the formation in which the coal is burning to cause additional fracturing of the coal formation.

12. A method of claim 9 wherein said oxidizing gas is air enriched with oxygen.

13. A method of claim 9 wherein said oxidizing gas is air.

14. A method for the fracturing of underground coal deposits comprising:

a. injecting an oxidizing gas through a wellbore and into an underground coal formation, said oxidizing gas being injected at a pressure substantially equal to or the fracturing exceeding the fracturing pressure of said coal formation;

b. igniting the coal in said underground coal formation; and c. injecting a predetermined amount of a cooling media to force the burning of the coal away from said wellbore.

15. A method of claim 14 further comprising:

extinguishing the burning coal.

16. A method of claim 14 further comprising:

injecting a slug of water into the formation in which the coal is burning to cause additional fracturing of the coal formation.

17. A method of claim 16 further comprising: extinguishing the burning coal.

18. A method of claim 14 wherein said predetermined amount of a cooling media is less than the amount needed to offset the BTUs produced by the burning coal.

19. A method of claim 14 wherein said oxidizing gas is injected at a pressure equal to or exceeding the fracturing pressure of said coal formation.

20. A method for the fracturing of underground coal deposits comprising:

a. injecting an oxidizing gas through a wellbore and into an underground coal formation, said oxidizing gas being injected at a pressure substantially equal to or exceeding fracturing pressure of said coal formation;

b. igniting the coal in said underground coal formation;

c. injecting a predetermined amount of a cooling media to force the burning of the coal away from said wellbore; and wherein the predetermined amount of cooling media is a quantity sufficient for the BTU value of the cooling media, air and coal is 60% or less of BTU value of the air and coal.

21. A method of claim 20 wherein said oxidizing gas is injected at a pressure equal to or exceeding the fracturing pressure of said coal formation.

22. A method for fracturing of underground coal deposits comprising:

a. providing a single open wellbore to an underground coal bearing formation;

b. injecting an oxidizing gas through said wellbore and into said underground coal formation;

c. igniting the coal in said underground coal formation;

d. injecting a predetermined amount of a cooling media to force the burning of the coal away from said wellbore; and e. extinguishing the burning coal.

23. A method of claim 22 wherein said oxidizing gas is air enriched with oxygen.

24. A method of claim 22 wherein said oxidizing gas is air.

25. A method of claim 22 wherein said cooling media is water.

26. A method of claim 22 wherein said predetermined amount of a cooling media is less than the amount needed to offset the BTUs produced by the burning coal.

27. A method for fracturing of underground coal deposits comprising:

a. providing a single open wellbore to an underground coal bearing formation;

b. injecting an oxidizing gas through said wellbore and into said underground coal formation;

c. igniting the coal in said underground coal formation;

d. injecting a predetermined amount of a cooling media to force the burning of the coal away from said wellbore; and e. injecting a slug of water into the formation in which the coal is burning to cause additional fracturing of the coal formation.

28. A method for fracturing of underground coal deposits comprising:

a. providing a single open wellbore to an underground coal bearing formation;

b. injecting an oxidizing gas through said wellbore and into said underground coal formation;

c. igniting the coal in said underground coal formation; and d. injecting a predetermined amount of a cooling media to force the burning of the coal away from said wellbore wherein said cooling media is a foam containing water.

29. A method for fracturing of underground coal deposits comprising:

a. providing a single open wellbore to an underground coal bearing formation;

b. injecting an oxidizing gas through said wellbore and into said underground coal formation;

c. igniting the coal in said underground coal formation;

d. injecting a predetermined amount of a cooling media to force the burning of the coal away from said wellbore; and wherein said oxidizing gas is injected at a pressure substantially equal to or exceeding the fracturing pressure of said coal formation.

30. A method for the production of clean gas from a coal formation comprising:

a. providing a single open wellbore to an underground coal bearing formation;

b. injecting an oxidizing gas through said wellbore and into said underground coal formation;

c. igniting the coal in said underground coal formation;

d. injecting a predetermined amount of a cooling media to force the burning of the coal away from said wellbore;

e. extinguishing the burning coal; and f. removing gas from said underground coal bearing formation through said wellbore.

31. A method of claim 27 wherein said cooling media is water.

32. A method of claim 9 wherein said cooling media is a foam containing water.

33. A method of claim 30 wherein the oxidizing gas is air enriched with oxygen.

34. A method of claim 30 wherein the oxidizing gas is air.

35. A method for the production of clean gas from a coal formation comprising:

a. providing one or more injecting wellbores to an underground coal formation;

b. sealing all other boreholes to said underground coal formation to which a burning could channel from one or more of said injecting wells during the time coal is being burned in said formation;

c. injecting an oxidizing gas through said one or more injecting wellbores and into said underground coal formation;

d. igniting the coal in said underground coal formation;

e. injecting a predetermined amount of a cooling media to force the burning of the coal away from said one or more injecting wellbores;

f. extinguishing the burning coal; and g. removing gas from said underground coal bearing formation through one or more of said wellbores.

* * * * *